United States Patent [19]

Grawey

[11] Patent Number: 4,643,249

[45] Date of Patent: Feb. 17, 1987

[54] HEAT EXCHANGER BAFFLE PLATE

[75] Inventor: Charles E. Grawey, Peoria, Ill.

[73] Assignee: Caterpillar Inc., Peoria, Ill.

[21] Appl. No.: 865,938

[22] Filed: May 19, 1986

Related U.S. Application Data

[60] Continuation-in-part of Ser. No. 713,359, Mar. 18, 1985, abandoned, which is a division of Ser. No. 443,811, Nov. 22, 1982, Pat. No. 4,520,868.

[51] Int. Cl.[4] ..... F28D 7/00

[52] U.S. Cl. ..... 165/159; 165/162; 165/905

[58] Field of Search ..... 165/159, 69, 162, DIG. 8

[56] References Cited

U.S. PATENT DOCUMENTS

| | | | |
|---|---|---|---|
| 2,225,856 | 12/1940 | Buck | 257/220 |
| 3,311,164 | 3/1967 | Cox et al. | 165/95 |
| 3,324,941 | 6/1967 | Divers | 165/173 |
| 3,332,479 | 7/1967 | Martin, Jr. | 165/158 |
| 4,221,261 | 9/1980 | Wunder et al. | 165/DIG. 8 X |
| 4,328,862 | 5/1982 | Gossalter | 165/158 |

FOREIGN PATENT DOCUMENTS

| | | | |
|---|---|---|---|
| 1064966 | 9/1959 | Fed. Rep. of Germany | 165/173 |
| 2339364 | 2/1975 | Fed. Rep. of Germany . | |
| 1089816 | 3/1955 | France | 15/2 |
| 1449311 | 8/1966 | France | 165/159 |
| 1578617 | 8/1969 | France . | |
| 1477839 | 6/1977 | United Kingdom . | |
| 515024 | 6/1976 | U.S.S.R. | 165/159 |

*Primary Examiner*—William R. Cline
*Assistant Examiner*—Peggy A. Neils
*Attorney, Agent, or Firm*—Robert A. McFall

[57] ABSTRACT

A heat exchanger baffle plate having a plurality of openings for receiving a plurality of longitudinally-extending tubes, is disposed within a shell and is constructed of a vibration-damping material.

2 Claims, 2 Drawing Figures

HEAT EXCHANGER BAFFLE PLATE

DESCRIPTION

This is a continuation-in-part of Ser. No. 713,359 filed Mar. 18, 1985 now abandoned, which was a division of Ser. No. 443,811 filed Nov. 22, 1982 now U.S. Pat. No. 4,520,868.

1. Technical Field

This invention relates generally to heat transfer and more particularly to an improved heat exchanger baffle plate.

2. Background Art

Heat exchangers comprising a tube bundle enclosed in a case or housing, generally identified as shell-and-tube type heat exchangers, are well known. Traditionally, shell-and-tube heat exchangers have been constructed of metallic materials. In particular, the tube bundle has conventionally been formed of a plurality of elongated metal tubes that are brazed in a predetermined pattern to a pair of end walls and one or more internal baffle plates. Such brazed assemblies are not only costly, but are also prone to both thermal and vibration-induced mechanical fatigue cracking and subsequent leakage between the fluid chambers at the brazed joints and at the contact points between the tubes and the internal baffle plates. Further, the brazing process tends to anneal the metal tubes, thereby reducing the yield strength of the tubes. In high pressure applications, annealed tubes may collapse, resulting in failure of the heat exchanger.

In an attempt to avoid the above-described inherent problems associated with brazed or soldered heat exchangers, various mechanical sealing arrangements have been proposed. One such example is the tube bundle heat exchanger described in U.S. Pat. No. 4,328,862 issued May 11, 1982 to Rene Gossalter. The Gossalter patent discloses an elastic sealing means for a heat exchanger wherein a pair of pressure plates exert a force in the longitudinal direction of the tube bundle to expand the elastic sealing means in a transverse, or radial, direction thus confining the elastic sealing means in all directions. However, the Gossalter construction still presents a number of problems. First, the requirement for a pair of apertured pressure plates limits the number of tubes that may be enclosed within the shell. As the number of tubes in the tube bundle increases, the number of apertures provided in the pressure plates through which the tubes pass, must also increase. Typically, a 152 mm (6 in.) diameter heat exchanger may contain about 600 tubes having a 4.78 mm (0.188 in. diameter). Forming 600 clearance holes in each of the pressure plates as required in the Gossalter arrangement would not only be extremely costly and time consuming but would also significantly weaken the plate. If the thickness of the pressure plates were increased to add strength, the cost and difficulty of forming the required number of clearance holes would also increase. Further, the pressure plate would be structurally weaker towards the center of the plate and would be unable to apply a uniform, equal compression force across the complete elastic medium interface surface.

An additional deficiency in the prior art as demonstrated in the Gossalter construction is that as the axially applied compressive pressure increases, the sealing surface contact area between the elastic medium and the tubes and shell wall also decreases. Further, if the clamping bolts are overly tightened, the confined elastic medium may easily collapse some of the tubes, especially the relatively small diameter tubes found in high efficiency, high density heat exchangers. This attribute is further worsened by the tendency of maintenance personnel to tighten the clamping bolts if leakage is detected.

It has been found that tube fractures may also occur at the surface contact points between the tubes and one or more internal baffle plates. For ease in assembly, it is generally accepted practice to form tube-encircling apertures in the baffle plate to the same or a slightly larger diameter than the external diameter of the tubes. During operation of the heat exchanger, it has been found that the tubes are often subjected to severe vibration both from external sources and from internal fluid pressure pulses. Initially, the lateral displacement or movement of the tubes during various vibrational modes is limited by the close-fitting baffle plates. However, after repeated forced contact either the tubes or the plate, or both, may wear or deform and the clearance between the tube and baffle aperture becomes greater, thereby permitting increased movement of the tube within the baffle. This action not only leads to early mechanical or fatigue failure of the tube but also permits fluid to pass through the enlarged aperture thereby decreasing the flow-directing function of the baffle.

The present invention overcomes the problem of vibration-induced internal tube damage by providing a vibration-damping baffle plate constructed of a non-metallic material that is considerably softer than the material of the tubes. Further, the baffle plates of the present invention provide an effective, non-abrading, vibration energy absorbing support between each of the tubes and each of the plates.

DISCLOSURE OF THE INVENTION

In accordance with one aspect of the present invention, a one-piece baffle plate for supporting a plurality of tubes in a heat exchanger is constructed of a vibration energy absorbing material having a hardness significantly less than the hardness of the tubes, and a plurality of openings formed through the plate, each opening being defined by a continuous sidewall having a uniform dimension through the plate.

BEST MODE FOR CARRYING OUT THE INVENTION

Figure 1:
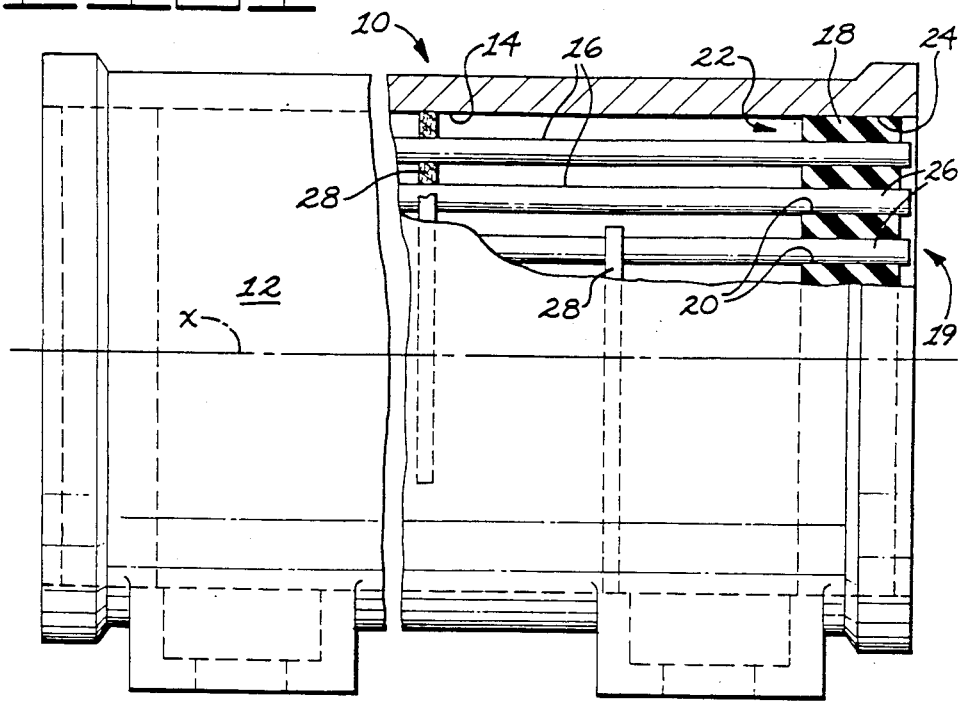
FIG. 1 is a partially sectioned, elevational view of a heat exchanger embodying the present invention.
Figure 2:
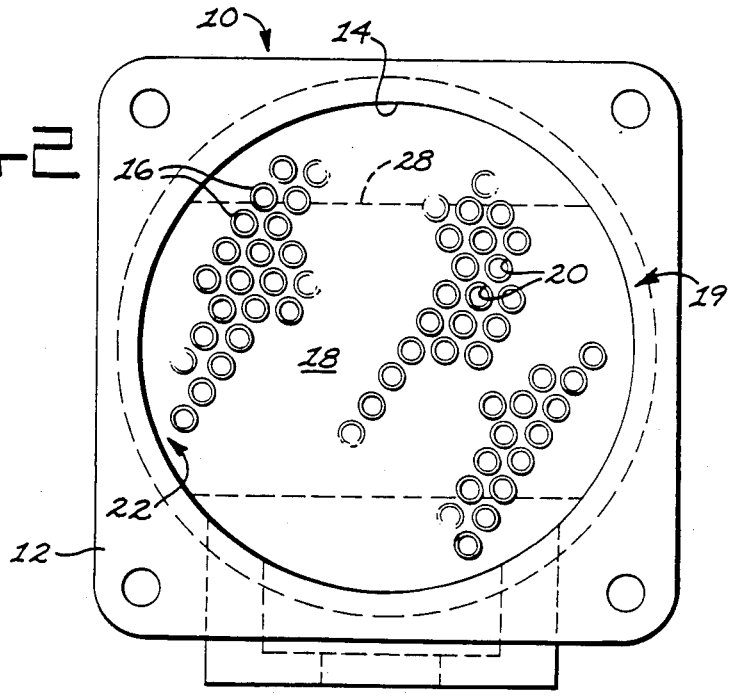
FIG. 2 is an end view of the heat exchanger of FIG. 1.

In the preferred embodiment of the present invention, a heat exchanger 10 includes a conventional shell 12 having an inner wall 14 and a plurality of longitudinally extending tubes 16 disposed within the shell 12. In the example shown in FIG. 1, the heat exchanger 10 is of the single-pass type and has a pair of elastomeric end plates 18 forming part of an end plate assembly 19 at each end of the shell 12 with each of the tubes 16 extending through a respective aperture 20 formed through each of the end plates 18. In heat exchangers of the double-pass type, one end of the heat exchanger may have a solid end wall and the opposite end have an apertured elastomeric end plate assembly 19 constructed according to the present invention. The heat exchanger 10 also includes a plurality of non-metallic internal baffle plates 28 disposed inwardly of the shell 12 at predetermined spaced positions along and normal to the longitudinal axis X of the tubes 16.

Preferably, the elastomeric end plate 18 is constructed of a natural or synthetic resin material having a hardness of from about 45 durometer to about 80 durometer as measured in the Shore A scale. It is necessary that the hardness of the end plate 18 be sufficient to support the tubes 16 in a sealed relationship with respect to the internal chamber defined by the shell 12 and yet not be adversely axially deflected by high pressure pulses that may be transmitted by fluid in the shell chamber. Also, the hardness should not be so high that the transverse compressive stress required for sealing the tube and chamber is not greater than the transverse crush strength of the tubes 16. In addition, the end plate material should have good resistance to the effects of both high and low temperatures and in particular should be resistant to temperature induced deterioration within the thermal operating range of the heat exchanger 10. Further, the end plate material should have good resistance to the deleterious effects of the particular fluids that may be passed through the heat exchanger 10. While by no means being an all-inclusive list, examples of materials having these properties include some compounds of natural rubber, synthetic rubber, and thermoset elastomers such as butyl rubber, chlorosulfonated polyethylene, chloroprene (neoprene), chlorinated polyethylene, nitrile butadiene, epichlorohydrin, polyacrylate rubber, silicone, urethane, fluorosilicone and fluorocarbon, and thermoplastic elastomers such as polyurethane, copolyester and polyolefin.

The baffle plates 28 are preferably constructed of a non-metallic, vibration-energy absorbing material having a hardness substantially less than the hardness of the tubes 16, such as fiber-reinforced neoprene rubber having a durometer hardness of about 65 to 80 on the Shore D scale. Other suitable materials include but are not limited to the compounds listed above with respect to the end plate 18. Combinations of the listed compounds and various metallic, mineral or organic fiber fillers are particularly useful.

A means 22 for compressing the elastomeric end plate 18 includes a continuous surface 24 on the inner wall 14 of the shell 12. The surface 24 circumscribes a transverse area that is somewhat smaller than the unconfined or free-state transverse area of the end plate 18. Further, the means 22 for compressing the elastomeric end plate 18 includes, in combination with the inner wall 14 of the shell 12, an external surface area 26 on each of the tubes 16. The free-state transverse area of each of the apertures 20 is somewhat smaller than the transverse or cross-sectional area of each of tubes 16 so that the external surface area 26 on each of the tubes 16 will urge a portion of the end plate 18 immediately surrounding, or circumscribing, each of the tubes 16 in a direction radially outwardly and maintain a stress on the end plate 18 in a transverse direction with respect to the longitudinal orientation of the tubes 16.

In an illustrative example, the shell 12 of the heat exchanger 10 is constructed of a ferrous metal composition, has a length of about 762 mm (30.0 in.) and an inner wall 14 diameter of 164.64 mm (6.482 in.). The tubes 16 are copper, have a length of 759 mm (29.88 in.), an outer diameter of 4.78 mm (0.188 in.) and an inner diameter of 4.17 mm (0.164 in.). The tubes 16 are carefully arranged in offset parallel rows inside the shell to provide a large number of tubes and consequently a large heat transfer surface area. The example heat exchanger 10 of the present invention contains 579 of the tubes 16, providing a tube/cross-section area ratio of about 2.7 tubes/cm$^2$. High tube density heat exchangers in this general size group typically range from about 1 to about 3 tubes/cm$^2$.

The baffle plates 28 provide support and alignment for the tubes 16 which pass through apertures formed in each of the baffle plates. Further, as is well known in the art, baffle plates form a series of partial dams or flow-directing walls within the shell to provide improved circulation and heat transfer between fluid passing through the shell chamber and fluid passing through the tubes. Conventionally, baffle plates are constructed of a metal and are mechanically positioned within the shell 12 to prevent movement of the baffle plates during operation of the heat exchanger. In the preferred embodiment of the present invention, the baffle plates 28 are constructed of a fiber-filled neoprene rubber—a non-metallic, vibration-energy absorbing, sheet material, having a Shore D durometer hardness of about 65 to 80 and a thickness of 3 mm (0.120 in.). The fiber reinforcement may be randomly oriented asbestos fibers or multiple plys of woven polyester fabric. The baffle plates 28 can be adhesively bonded to the external surface of at least some of the copper tubes 16 with nitrile phenolic adhesive to establish an initial position for assembly purposes. The plurality of openings formed in each of the baffle plates 28 for passage of the heat exchanger tubes 16, each have a dimension substantially the same as the outer diameter of the tubes 16. It has been found that with somewhat resilient materials, such as the fiber-filled neoprene composition of the preferred embodiment, the openings in the baffle plate 28 tend to diminish in cross-sectional area after forming. This characteristic, in combination with the greater thickness of the baffle plate serves to support a sufficient length of the tube to avoid the sharp edges and deleterious wear attributable to the thin metal plates of the prior art constructions. Further, it has been found that the fiber-filled neoprene composition of the preferred embodiment tends to swell slightly in the presence of oil, thereby increasing the mechanical support and decreasing the amount of leakage about each of the tubes 16 and accordingly improving the heat transfer performance when oil is the fluid medium circulated through the outer chamber of the heat exchanger 10.

Industrial Applicability

Heat exhangers 10 having the baffle plate assemblies of the present invention have been found to be particularly suitable for use in vehicular applications. The high vibration, cyclic pressure and heat load requirements of vehicle engine, transmission and hydraulic accessory systems have only marginally been satisfied by conventional brazed-assembly metallic heat exchangers.

The heat exchanger is believed suitable for a large number of applications wherein the performance requirements are severe and where heat exchangers of prior art constructions have been inadequate or prone to high failure rates.

Other aspects, objects and advantages of this invention can be obtained from a study of the drawings, the disclosure and the appended claims.

What is claimed is:

1. A one-piece baffle plate for supporting a plurality of tubes of predetermined hardness in spaced relation to each other and to a shell of a heat exchanger through which oil passes around the tubes, the baffle plate being formed from a single sheet of vibration-absorbing fiber-reinforced neoprene rubber having a hardness of about 65 to 80 durometer as measured on the shore D scale and less than the tube hardness, having a thickness of about 3 mm, and having an ability to swell in the presence of oil; the plate having a plurality of circular openings therethrough for the tubes; each of the openings being defined by a continuous sidewall having a uniform dimension through the plate and shaped and sized to correspond to the shape and size of the outer surfaces of the tubes and having a density of from about 1 to about 3 openings/$cm^2$ of the surface area of said plate; the plate having substantially flat faces and a peripheral surface that is substantially perpendicular to the face surfaces, the perpendicular surface being shaped to fit against a corresponding portion of the interior of the shell, and the plate being sized and shaped to permit flow through the heat exchanger.

2. A baffle plate, as set forth in claim 1, wherein said fiber-reinforced neoprene rubber comprises a plurality of woven polyester fabric plys and neoprene rubber.

* * * * *